US006955729B2

(12) United States Patent
Honkura et al.

(10) Patent No.: US 6,955,729 B2
(45) Date of Patent: Oct. 18, 2005

(54) ALLOY FOR BONDED MAGNETS, ISOTROPIC MAGNET POWDER AND ANISOTROPIC MAGNET POWDER AND THEIR PRODUCTION METHOD, AND BONDED MAGNET

(75) Inventors: Yoshinobu Honkura, Aichi-ken (JP); Norihiko Hamada, Aichi-ken (JP); Chisato Mishima, Aichi-ken (JP)

(73) Assignee: Aichi Steel Corporation, Tokai (JP)

( * ) Notice: Subject to any disclaimer, the term of this patent is extended or adjusted under 35 U.S.C. 154(b) by 221 days.

(21) Appl. No.: 10/182,724

(22) PCT Filed: Jun. 28, 2002

(86) PCT No.: PCT/JP02/06547

§ 371 (c)(1),
(2), (4) Date: Jan. 27, 2003

(87) PCT Pub. No.: WO03/085147

PCT Pub. Date: Oct. 16, 2003

(65) Prior Publication Data

US 2003/0209294 A1 Nov. 13, 2003

(30) Foreign Application Priority Data

Apr. 9, 2002 (JP) ..... PCT/JP02/03523
May 8, 2002 (JP) ..... PCT/JP02/04491

(51) Int. Cl.[7] ..... H01F 1/057
(52) U.S. Cl. ..... 148/302; 148/122; 420/83; 420/121; 252/62.54
(58) Field of Search ..... 148/302, 122; 420/83, 121; 252/62.54, 62.55

(56) References Cited

U.S. PATENT DOCUMENTS 4,402,770 A 9/1983 Koon
4,684,406 A * 8/1987 Matsuura et al. ..... 75/244
4,767,474 A * 8/1988 Fujimura et al. ..... 148/302

(Continued)

FOREIGN PATENT DOCUMENTS

EP 0 106 948 A2 * 5/1984
JP 60-187662 9/1985
JP 6-128610 5/1994

(Continued)

OTHER PUBLICATIONS

G. Yi et al.: "TEM studies of the effects of Zr additions on some HDDR–processed, high boron, NdFeB–type powders and hot–pressed magnets" Journal of Magnetism and Magnetic Materials, vol. 220, pp. 115–123 2000.
N.C. Koon et al.: "Crystallization of FeB alloys with rare earths to produce hard magnetic materials (invited)" J. Appl. Phys., vol. 55, No. 6, pp. 2063–2066 Mar. 15, 1984.
J.J. Croat et al.: "Pr–Fe and Nd–Fe–based materials: A new class of high–performance permanent magnets (invited)" J. Appl. Phys., vol. 55, No. 6, pp. 2078–2082 Mar. 15, 1984.
C. Mishima et al.: "Dependence of the hydrogen pressure on the magnetic properties of NdFeB anisotropic magnet powders produced by the HDDR method" Journal of the Japan Applied Magnetics Society, vol. 24, pp. 407–410 2000.

*Primary Examiner*—John P. Sheehan
(74) *Attorney, Agent, or Firm*—Oblon, Spivak, McClelland, Maier & Neustadt, P.C.

(57) ABSTRACT

An alloy for bonded magnets of the present invention includes at least a main component of iron (Fe), 12–16 atomic % (at %) of rare-earth elements (R) including yttrium (Y), and 10.8–15 at % of boron (B), and is subjected to a hydrogen treatment method as HDDR process or d-HDDR process.

Using the magnet powder obtained from carrying out d-HDDR processing, etc. on this magnet alloy, pellets with superior insertion characteristics into bonded magnet molding dies can be obtained, and bonded magnets with superior magnetic properties and showing low cost can be obtained.

21 Claims, 2 Drawing Sheets

Degree of Fluidity

U.S. PATENT DOCUMENTS

| | | | | | |
|---|---|---|---|---|---|
| 4,792,368 | A | * | 12/1988 | Sagawa et al. | 148/302 |
| 4,802,931 | A | | 2/1989 | Croat | |
| 4,851,058 | A | | 7/1989 | Croat | |
| 4,981,532 | A | * | 1/1991 | Takeshita et al. | 148/302 |
| 5,338,371 | A | * | 8/1994 | Nakayama et al. | 148/101 |
| 5,411,608 | A | | 5/1995 | Hazelton et al. | |
| 5,417,773 | A | * | 5/1995 | Nakayama et al. | 148/101 |
| 5,486,239 | A | * | 1/1996 | Nakayama et al. | 148/101 |
| 6,056,830 | A | | 5/2000 | Honkura et al. | |
| 6,444,052 | B1 | | 9/2002 | Honkura et al. | |

FOREIGN PATENT DOCUMENTS

| | | |
|---|---|---|
| JP | 7-68561 | 7/1995 |
| JP | 7-188704 | 7/1995 |
| JP | 8-41502 | 2/1996 |
| JP | 8-51007 | 2/1996 |
| JP | 2576671 | 11/1996 |
| JP | 2576672 | 11/1996 |
| JP | 2586198 | 12/1996 |
| JP | 2586199 | 12/1996 |
| JP | 2665658 | 6/1997 |
| JP | 9-165601 | 6/1997 |
| JP | 2001-76917 | 3/2001 |
| JP | 2001-148306 | 5/2001 |
| JP | 2002-25813 | 1/2002 |
| JP | 2002-093610 | 3/2002 |

* cited by examiner

Cost Performance

ALLOY FOR BONDED MAGNETS, ISOTROPIC MAGNET POWDER AND ANISOTROPIC MAGNET POWDER AND THEIR PRODUCTION METHOD, AND BONDED MAGNET

TECHNICAL FIELD

This invention relates to the alloy for bonded magnets, which makes a bonded magnet with superior magnetic characteristics and lower cost, the isotropic or anisotropic magnet powder attained from such magnet alloy, their respective production methods, and the bonded magnets attained from such magnet powder.

BACKGROUND ART

Hard magnets (permanent magnets) are used in motors and various other equipment. Above all, automobile motors, etc. have the strongest demands in terms of miniature size and high output. This type of hard magnet with superior magnetic characteristics is of course demanded at a low price due to worldwide competition. First, from the viewpoint of high performance, the development of a RfeB-type magnet (rare-earth magnet), made from a rare-earth element (R), Boron (B) and Iron (Fe), has up until now been popular.

In the way of these RFeB-type magnets, RFeB-type isotropic magnet alloys that possess magnetic isotropy have been released, for example U.S. Pat. No. 4,851,058 (referred to as "Prior Technology 1" below) and U.S. Pat. No. 5,411,608 (referred to as "Prior Technology 2" below).

Specifically, in Prior Technology 1, a magnet alloy with approximately 10–40 at % Nd, Pr or Nd and Pr, approximately 50–90 at % Fe, and approximately 0.5–10 at % B is disclosed. In Prior Technology 2, a magnet alloy is disclosed with the content of 12–40 at % Nd, Pr or Nd and Pr, not more than 10 at % Co, 3–8 at % B, and a remainder of Fe. In Prior Technology 2, through the addition of Co, the heat resistance was increased upon an increase in Curie temperature. Both of these Prior Technologies result in magnet powder with the above-mentioned composition through a type of quenching solidification called melt-spun method.

This magnet powder has many uses industrially as a raw material powder for bonded magnets (hard magnets). The bonded magnets are obtained by, for example, first making pellets from this magnetic powder and a resin binder, then inserting the pellets into a die for molding, and then carrying out compression molding. In general, when the pellets are inserted into the mold, if the degree of fluidity ($s \cdot g^{-1}$) is small, the time required for pellet insertion will be short, and thus the productivity of the bonded magnets will be increased. Moreover, if the apparent density of the pellets is high, uniform pellet insertion into the mold becomes possible and the failure rate of the bonded magnets can be reduced. Therefore, with a small degree of fluidity and a high apparent density, the cost reduction of the bonded magnet can be achieved resulting in a very economical magnet. The degree of fluidity and apparent density depend on the particle shape of the magnet powder, that is to say that ideal degree of fluidity and apparent density are obtained from a spherical shape.

However, the shape of the magnetic powder particles produced by the above-mentioned Prior Technology 1 and 2 is a ribbon shape with thickness of 20–50 $\mu$m, and when compared to the case of a round shape, have a large degree of fluidity and small apparent density. Of course on can think to crush this ribbon shape to make a spherical shape thus making a small degree of fluidity and a large apparent density. However, this would increase the number of production steps and even if a spherical shape is achieved, in fact, it is difficult to effectively make the degree of fluidity small and the apparent density large. This is because the original particle size is at maximum 50 $\mu$m and in general it is easy to get adhesion/cohesion with powder not more than 50 $\mu$m.

Moreover, the situation is the same even with a SmFeN-type magnet powder, which has a different composition than that mentioned above. Even if the magnet powder particle size is close to a spherical shape, and it is made to be a fine powder with an average particle diameter of 1–5 $\mu$m, it is easy to get adhesion/cohesion and the degree of fluidity and apparent density become worse.

Therefore, alternative production methods of magnet powder, other than the above-mentioned melt spinning method, include the HDDR (hydrogenation-disproportionation-desorption-recombination) processing method and the d-HDDR processing method. The magnet powder acquired by these methods have virtually a spherical particle shape and therefore have the degree of fluidity and apparent density that are much superior to the magnet powder acquired by the above-mentioned Prior Technology 1 and 2.

The HDDR processing method is used to produce RFeB-type isotropic magnet powder and RFeB-type anisotropic magnet powder, and it generally has two production steps. That is to say, the first step of 3-phase decomposition (disproportionation) reaction (the hydrogenation step) is carried out while maintained at 773–1273 K in a hydrogen gas environment on the order of 100 kPa (1 atm), and after that is the dehydrogenation step (the second step) where dehydrogenation occurs under vacuum.

On the other hand, d-HDDR is used predominantly in as a production method for RFeB-type anisotropic magnet powder. As reported in detail in commonly-known literature (Mishima, et. al.: Journal of the Japan Applied Magnetics Society, 24 (2000), p. 407), it is defined as the control of the reaction rate between the RFeB-type alloy and hydrogen when going from room temperature to a high temperature. In detail, the four principal production steps are the low-temperature hydrogenation step (step 1) where hydrogen is sufficiently absorbed into the RFeB-type alloy at room temperature, the high-temperature hydrogenation step (step 2) where the 3-phase decomposition (disproportionation) reaction occurs under low hydrogen pressure, the evacuation step (step 3) where hydrogen is decomposed under as high a hydrogen pressure as possible, and the dehydrogenation step (step 4) where the hydrogen is removed from the material. The point which differs from the HDDR process is that through the preparation of multiple production steps with different temperatures and hydrogen pressures, the reaction rate of the RFeB-type alloy and hydrogen can be maintained relatively slow, thus securing homogeneously anisotropic magnet powder.

The following Prior Technologies can be given as examples of these various processes used in magnet powder production methods.

First, the production method of RFeB-type isotropic magnet powder using the HDDR process is disclosed in the Japanese Examined Patent Publication (Kokoku) No. 7-68561 (U.S. Pat. No. 2,041,426: hereafter referred to as Prior Technology 3). According to this Prior Technology 3, the magnet powder is produced by carrying out crushing step and homogenizing heat treatment step, and after that carrying out the above-mentioned HDDR process on an alloy ingot with a main composition of R, Fe and B. Here, in this situation, the two steps prior to the HDDR process (the crushing step and the homogenizing heat treatment step) are essential to obtain an isotropic magnet powder with great magnetic properties. AS is even written in Prior Technology 3, if these two steps are omitted and magnet powder is produced by the direct HDDR processing of RFeB-type cast alloy, the bonded magnet made from the resulting magnet powder will have an extremely low value of coercivity (hereafter referred to as iHc) at a maximum of 0.76 MAm-1.

Additionally, these two steps come with a high cost and uneconomical. In particular, a homogenizing heat treatment step carried out at a high processing temperature between 873–1473 K will double the cost of the HDDR process, thus being very uneconomical.

Next, the RFeB-type anisotropic magnet powder production method, etc. using the HDDR process is disclosed in U.S. Pat. No. 2,576,671 (hereafter referred to as Prior Technology 4), U.S. Pat. No. 2,576,672 (hereafter referred to as Prior Technology 5), U.S. Pat. No. 2,586,198 (hereafter referred to as Prior Technology 6) and U.S. Pat. No.2,586,199 (hereafter referred to as Prior Technology 7).

In an actual example of these Prior Technologies, magnetic powder was produced by carrying out a homogenizing heat treatment step and a crushing step and then carrying out the HDDR treatment on alloy ingot of approximately 10–20 at % R, approximately 5–20 at % B and a remainder of Fe with various additive elements. However, in the examples, the disclosed amount of B in the alloy was disclosed in detail for not more than 10.4 at %, but only disclosed for 10.4 at % and 20 at % for alloys with B content exceeding 10.4 at %. The (BH)max of the anisotropic bonded magnet made from the magnet powder with B composition of 10.4 at % was 83–112 kJ/m$^3$ and the iHc was 0.74–0.97 MA/m, while the (BH)max of the anisotropic bonded magnet made from the magnet powder with B composition of 20 at % was 80–93 kJ/m$^3$ and the iHc was 0.46–0.75 MA/m. These magnetic properties are not nearly sufficient, especially the significant decrease in iHc with a B composition up to 20 at %.

Moreover, in the case of the above-mentioned Prior Technology when the homogenizing heat treatment step is carried out at a high temperature between 1393–1413 K, the cost of production of the magnet powder is high and especially uneconomical. Of course, in this case, the omission of the homogenization heat treatment would reduce the cost, however as in the case of Prior Technology 3, there would be no avoiding a decrease in the iHc properties.

Incidentally, in reality it is very difficult to industrially mass produce isotropic magnet powder using the methods like those in Prior Technologies 4–7. This is because, in order to achieve magnet powder with excellent anisotropy, the temperature during the HDDR process must be controlled very strictly. To be specific, if the HDDR process is not carried out within a ±20 K range of the target temperature then high anisotropic magnet powder cannot be achieved. Additionally, if the amount processed per batch of HDDR process is increased, the generation of heat during the disproportionation reaction between hydrogen and RFeB-type alloy as well as the heat loss during the dehydrogenation will drastically increase, and the atmospheric temperature will become outside of the desired range. As a result of this, the magnetic properties, especially the anisotropy, of the magnet powder massed produced by methods such as Prior Technologies 4–7 are small.

Therefore, when mass producing RFeB-type anisotropic magnet powder, it is recommended that the d-HDDR process is used as disclosed in patents such as Japanese Unexamined Patent Publication No. 2001-148306 (hereafter referred to as Prior Technology 8) or Japanese unexamined Patent Publication No. 2001-76917 (hereafter referred to as Prior Technology 9) etc. With this d-HDDR process, even if the amount processed per batch is increased, a magnet powder having high anisotropy can be obtained. As mentioned above, in the case of d-HDDR processing, because the reaction rate between the RFeB-type alloy and hydrogen is controlled to be slow through a number of processing steps, the amount of heat generation during the disproportionation reaction between the RFeB-type alloy and hydrogen as well as the amount of heat loss during dehydrogenation can be controlled.

However, in the case of Prior Technologies 8 and 9, anisotropic magnet powder was produced by carrying out this d-HDDR processing after performing a homogenizing heat treatment step on an alloy ingot of approximately 12–15 at % R, approximately 6–9 at % B and a remainder of Fe. Because of this, the production cost was high, similar to the above-mentioned production methods.

Up to now the main introduction has been about the cost reduction of hard magnets with high properties, but when considering actual use, it is also important to have excellent properties over time such as corrosion resistance etc. In particular, there is a demand for superior heat resistance, etc. for hard magnets used in a high-temperature environment, such as in motors of household appliances and automobile motors, etc., from the point of view of securing motor reliability, etc.

However, for the above-mentioned rare-earth magnets, it is very easy for the properties of the Fe and R that are the main components of the composition to be reduced by oxidation corrosion etc., and therefore it is difficult to steadily ensure high magnetic properties. Especially in the case that rare-earth magnets are used above room temperature, there is a tendency for the magnetic characteristics to drop off drastically. The permanent demagnetization ratio (%) is usually used to index a magnet's change over time, and in the case of the prior rare-earth magnets, most of them had permanent demagnetization ratios exceeding 10%. Moreover, when held below a certain temperature for an extended period of time (over 1000 hours), the permanent demagnetization ratio does not return to its original level when remagnetized and the percentage of magnetic flux is reduced.

DISCLOSURE OF THE INVENTION

The present invention was developed in order to solve problems such as those mentioned above. That is to say, the purpose is to provide a low-cost, RFeB-type magnet powder with superior magnetic properties using the HDDR or d-HDDR process, without carrying out the costly homogenizing heat treatment step, the associated production method, and the bonded magnet made from this magnet powder. Additionally the purpose is to provide the RFeB-type magnet alloy suited to produce such magnet powder.

In summary, the purpose is to provide a low-cost bonded magnet with superior magnetic properties and little loss of properties over time, the RFeB-type magnet alloy from which such a hard magnet is made, the RFeB-type magnet powder as well as the production methods.

As a result of many types of systematic experiments and diligent research to solve these challenges, the present inventors accomplished the invention of the following magnetic alloy etc. with a different amount of B than the previous alloy.

(Alloy for Bonded Magnets)

First, the alloy for bonded magnets of the present invention includes at least a main component of iron (Fe), 12–16 atomic % (at %) rare-earth element (hereafter referred to as R) including yttrium (Y), and 10.8–15 at % boron (B).

In addition to this expression, it would also be alright to say that the magnet alloy of the present invention includes at least a main component of iron (Fe), 12–16 at % rare-earth element (hereafter referred to as R) including yttrium (Y), and 10.8–15 at % boron (B) and one type of hydrogen processing such as HDDR or d-HDDR is carried out.

The amount of B in the alloy for bonded magnets (hereinafter referred to as "magnet alloy") of the present invention is different than that of the RFeB-type magnet alloy developed up to now, having a comparably high amount of B. The present inventors found that in this magnet alloy with a lot of B, the precipitation of α-Fe as the primary crystal can be controlled. As a result of controlling the α-Fe precipitation having low magnetic characteristics, it has become possible to omit the homogenizing heat treatment step that until now was thought to be essential for the improvement of magnetic properties, and provide a low-cost magnet powder etc.

The reason for this can be thought of as follows with the increase of B, in the first stage of casting, the $R_1Fe_1B_4$ phase (hereafter referred to as the B-rich phase), which has a melting point 10–30 K lower than RFeB, is formed. It is thought that because of the inclusion of α-Fe as the primary crystal in this B-rich phase, the α-Fe precipitation can be controlled.

In this magnet alloy (for example this ingot, etc.), as a result of carrying out the above-mentioned HDDR process or d-HDDR process, a magnet powder with high iHc is obtained. This can be thought of in the following way. When the magnetic alloy of the present invention is hydrogenated, the above-mentioned B-rich phase and the magnetic phase, or $R_2Fe_{14}B$ phase, react sufficiently with hydrogen and become α-Fe, $Fe_2B$ and R hydride. And after that, when desorption is carried out, it is thought that the RFeB recrystallized grains are fine because the RFeB crystal grain growth is pinned by the fine, yet dense precipitation of the B-rich phase. It is favorable to effectively use the results of this pinning to, for example, to make the hydrogenation time not shorter than 360 minutes.

From this kind of point of view, B was raised to not less than 10.8 at %. By doing this, the very uneconomical homogenizing heat treatment step can be omitted, and an increase in iHc is seen. On the other hand, when B is increased greater than 15 at %, the volume fraction of the B-rich phase in the magnet powder increases, thus bringing on an unfavorable decrease in the maximum energy product (BH)max.

In examples of where Prior Technologies 4, 5, 6 and 7 have been put into practice, magnet powder with B content of 20 at % which has a low iHc of 0.46–0.75 $MAm^{-1}$ is disclosed. It is thought that this is because the B-rich phase fails to finely and densely precipitate during desorption after a short hydrogenation time of 240 minutes where the B-rich phase and hydrogen fail to sufficiently react.

Furthermore, when R is less than 12 at %, the primary crystal of α-Fe is easily precipitated, thus inducing a low iHc. On the other hand, when R is greater than 16% the (BH)max is unfavorably low.

For example, this R can be scandium (Sc), yttrium (Y), or lanthanum (La). Understandably, to get superior magnetic properties, it is ideal to use at least one of Y, lanthanum (La), cerium (Ce), praseodymium (Pr), neodymium (Nd), samarium (Sm), gadolinium (Gd), terbium (Tb), dysprosium (Dy), holmium (Ho), erbium (Er), thulium (Tm) as well as lutetium (Ly) for R. Out of these, it is especially desirable to use at least one of Pr, Nd or Dy for R in terms of cost as well as magnetic properties.

Furthermore, apart from the above-mentioned elements, it is desirable to add 0.1–6 at % of cobalt (Co) to the magnet alloy of the present invention, and even more desirable to add 0.1–6 at %. This is because Co is an element that will increase the Curie temperature of the magnet, as well as increasing the heat durability. However, as Co is expensive, from an manufacturing point of view, not more than 6 at % is desirable.

In the magnet alloy of the present invention, it is favorable to include at least one of gallium (Ga), zirconium (Zr), vanadium (V), aluminum (Al), titanium (Ti), hafnium (Hf) or copper (Cu) (hereafter referred to as Group 1 Elements) with a total amount of 0.1–2 at %. These elements improve the coercivity iHc of the magnet.

In the magnet alloy of the present invention, it is favorable to include at least one of niobium (Nb), tantalum (Ta) or nickel (Ni) (hereafter referred to as Group 2 Elements) with a total amount of 0.1–2 at %. These elements improve the residual remanence Br of the magnet.

The maximum energy product (BH)max can be improved with the addition of both elements from the Group 1 Elements and Group 2 Elements). In any case, if the total is less than 0.1 at % there is no actual effect, and if more than 2 at % the iHc, Br and (BH)max will decrease bringing on an undesirable result. If you think of cost and magnetic properties, it is desirable to have a content of 0.1–1.0 at %, or better yet 0.2–0.4 at % (on the order of 0.3 at %) Ga and 0.1–1.0, or better yet 0.1–0.4 at % (on the order of 0.2 at %) Nb.

Needless to say, unavoidable impurities may exist to a certain extent in the alloy and powder, etc. of the present invention. Their composition accounts for the differences in the Fe balance, where the total composition of Fe and impurities is between 59–77.2 at %.

Furthermore, in addition to the above-mentioned R's, it is desirable for the magnet alloy of the present invention to have 0.001–1.0 at % of La content. Via this, the deterioration of properties of the magnet powder and hard magnet made from the magnet alloy can be suppressed.

This is because La has the largest oxidation potential of all rare-earth elements (R.E.). Because of this, La content can suppress the oxidation of the magnet powder and hard magnet because La is used as a so-called oxygen getter and is chosen (at a priority) to be oxidized before the above-mentioned R's (Nd, Dy, etc.). Dy, Tb, Nd, Pr, etc. can be used in place of La, however these elements have not been sufficiently shown to control the oxidation of the magnet powder or hard magnet. In addition, it is more favorable to use La over these other elements with respect to cost. Moreover, the R in this magnet alloy is a rare earth element other than La.

Here, when La is included on the order of small amounts that exceed that of the unavoidable impurity level in the magnet alloy, an improvement effect on the corrosion resistance, etc. is found. As the unavoidable impurity level of La is less than 0.001 at %, the La amount of the present invention is not less than 0.001 at %. On the other hand, more than 1.0 at % yields the unfavorable result of lowering the iHc. Here, lower limits of La amount of 0.01 at %, 0.05 at % and 0.1 at % were found to have sufficient improvement effect on the corrosion resistance, and are agreeable. From the viewpoint of improvement of the corrosion resistance and control of iHc decrease, a La amount of 0.01–0.7 at % is the most desirable.

Furthermore, with an alloy composition including La, the alloy composition would not be one securing the existence of a single, or near-single, $R_2Fe_{14}B_1$ phase, but would be an alloy composition with a multi-phase structure with a $R_2Fe_{14}B_1$ phase, a B-rich phase, etc.

(Magnet Powder and its Production Method)

The magnet alloy of the present invention is not specified with relation to its shape; it can be an ingot or a powder. In the case of powder, there is no distinction of powder diameter or powder shape, etc. So, for example, the magnet alloy of the present invention can include isotropic magnet powder or anisotropic powder.

For example, isotropic magnet powder of the present invention can be obtained by production by the HDDR process which includes putting an ingot, with alloy composition of at least the main component Fe, R including Y of 12–16 at %, and B of 10.8–15 at %, through the hydrogenation step while maintaining the ingot between 1023–1173 K in a hydrogen atmosphere, and then after said hydrogenation step, carrying out the desorption step where hydrogen is removed.

On the other hand, anisotropic magnet powder of the present invention can be obtained by production by the d-HDDR process which includes putting an ingot, with alloy composition of at least the main component Fe, R including Y of 12–16 at %, and B of 10.8–15 at %, through the low-temperature hydrogenation step while maintaining the ingot at not more than 873 K in a hydrogen atmosphere, and then after the low-temperature hydrogenation step, carrying out the high-temperature hydrogenation step while maintaining 20–100 kPa and 1023–1173 K in a hydrogen atmosphere, and then after the high-temperature hydrogenation step, carrying out the first evacuation step while maintaining 0.1–20 kPa and 1023–1173 K in a hydrogen atmosphere, and after the first evacuation step, carrying out the second evacuation step where the hydrogen is removed.

(Bonded Magnet)

Moreover, by using these magnet powders, low-cost, high-performance bonded magnets can be obtained.

For example, in the case using isotropic magnet powder, the boned magnet of the present invention is characterized by mixing binder and isotropic magnet powder obtained by putting an ingot, with alloy composition of at least the main component Fe, R including Y of 12–16 at %, and B of 10.8–15 at %, through the HDDR process in which the hydrogenation step is carried out while maintaining the ingot between 1023–1173 K in a hydrogen atmosphere, and then after the hydrogenation step, the desorption step is carried out where hydrogen is removed.

Or, in the case using anisotropic magnet powder, the boned magnet of the present invention is characterized by mixing binder and anisotropic magnet powder obtained by putting an ingot, with alloy composition of at least the main component Fe, R including Y of 12–16 at %, and B of 10.8–15 at %, through the d-HDDR process in which the low-temperature hydrogenation step is carried out while maintaining the ingot at not more than 873 K in a hydrogen atmosphere, and then after the low-temperature hydrogenation step, the high-temperature hydrogenation step is carried out while maintaining 20–100 kPa and 1023–1173 K in a hydrogen atmosphere, and then after the high-temperature hydrogenation step, the first evacuation step is carried out while maintaining 0.1–20 kPa and 1023–1173 K in a hydrogen atmosphere, and after the first evacuation step, the second evacuation step is carried out where the hydrogen is removed.

The above-mentioned R, Co, Group 1 Elements and Group 2 Elements are suitable for the above-mentioned isotropic magnet powder, anisotropic magnet powder, as well as their production methods and bonded magnets. In addition, this also holds true for La addition, as will be described in detail below.

SIMPLE EXPLANATION OF THE DRAWINGS

THE BEST MODE FOR WORKING OF THE PRESENT INVENTION

A. Mode

Figure 1:
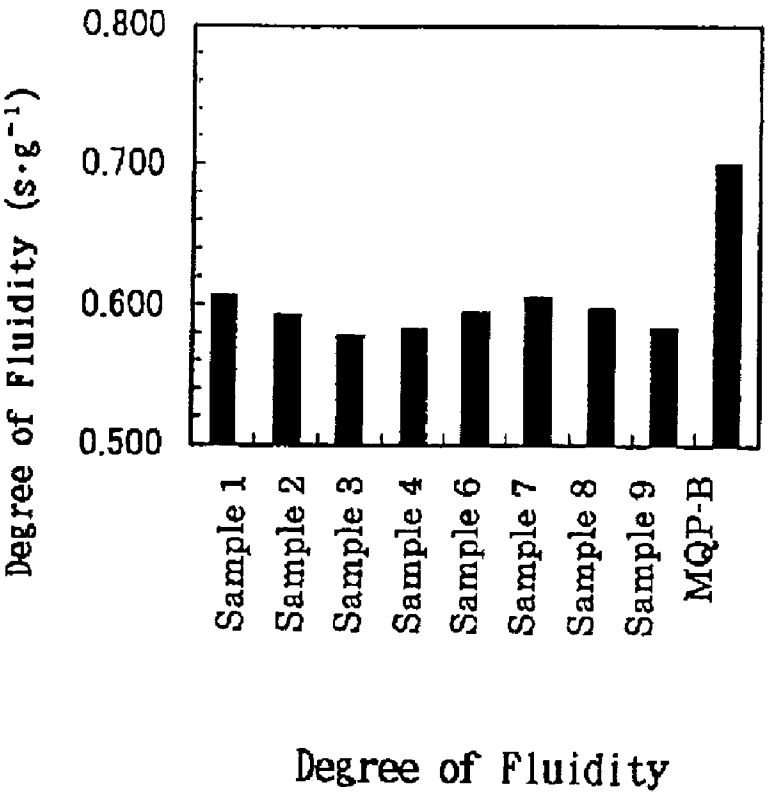
FIG. 1 shows a bar graph comparison of the degrees of fluidity of bonded-magnet-use pellets made from various magnet powders.

All of the following modes are described detail in the present invention (1) Magnet Powder and its Production Method The magnet powder of the present invention is obtained by carrying out the above-mentioned HDDR process or d-HDDR process on the above-mentioned magnet alloy ingot or coarse powder (particles).

(a) HDDR Processing Method

The HDDR process related to the present invention, as mentioned above, includes carrying out the hydrogenation step and desorption step on an alloy (ingot) with composition of 10.8–15 at % B.

In detail, the desorption step is, for example, carried out in an atmosphere with hydrogen pressure of not more than $10^{-1}$ Pa. And it is good if the temperature during the desorption step is, for example, 1023–1173 K. The hydrogen pressure in this document is, unless specified, the hydrogen partial pressure. Accordingly, as long as during the various steps the hydrogen partial pressure is within the specified values, it is acceptable to have a mixture with inert gasses, etc.

The above-mentioned processing times for the various steps are based on the processing amount of a single batch. For example, if the processing amount for a single batch were 10 kg, it is best to carry out the hydrogenation step on the order of 360–1800 minutes, and the desorption step on the order of 30–180 minutes. Other than that, the HDDR process itself is reported on in detail in the above-mentioned Prior Technology 3, etc. and it would be best to consult that as appropriate.

The magnet powder obtained by this HDDR processing method has industrial significance as isotropic magnet powder. This magnet powder has, for example, the superior magnetic characteristics of iHc of 0.8–1.7 (MA/m) and (BH)max of 60–120 (kJ/m$^3$).

Next the relation between the HDDR processing steps and the magnet alloy of the present invention with the above-mentioned B-rich composition.

In the first step of HDDR, or the hydrogenation step, hydrogen and the RFeB-type alloy or hydrogen and the B-rich phase react sufficiently. Following that, in the second step, or the desorption step, the B-rich phase precipitates into fine, dense particles. Then, this fine, densely precipitated B-rich phase pins the RFeB crystal grain growth, thus making the RFeB crystal grains fine. It is through this that a high coercivity (iHc) can be obtained.

(b) d-HDDR Processing Method

The d-HDDR process related to the present invention, as mentioned above, includes carrying out the low-temperature hydrogenation step, high-temperature hydrogenation step, first evacuation step and second evacuation step on an alloy (ingot) with composition of 10.8–15 at % B.

The conditions of the high-temperature hydrogenation step and the first evacuation step have been mentioned above. The low-temperature hydrogenation step is, for example, carried out in an atmosphere with a hydrogen pressure of 30–200 kPa. The second evacuation step is, for example, carried out in an atmosphere with a hydrogen pressure not more than $10^{-1}$ Pa, and with a temperature of, for example, on the order of 1023–1173 K. The combination of the first evacuation step and the second evacuation step make up the desorption step.

The above-mentioned processing times for the various steps are based on the processing amount of a single batch. For example, if the processing amount for a single batch were 10 kg, it is best to carry out the low-temperature hydrogenation step for not shorter than 30 minutes, the high-temperature hydrogenation step on the order of 360–1800 minutes, the first evacuation step on the order of 10–240 minutes and the second evacuation step on the order of 10–120 minutes. Other than that, the d-HDDR process itself is reported on in detail in the above-mentioned Prior Technology 9, etc. and it would be best to consult that as appropriate.

The magnet powder obtained via this d-HDDR processing method is an anisotropic magnet powder showing superb magnetic characteristics. These characteristics are, for example, iHc of 0.8–1.7 (MA/m) and (BH)max of 190–290 ($kJ/m^3$).

Next the relation between the d-HDDR processing steps and the magnet alloy of the present invention with the above-mentioned B-rich composition.

In the first step of the d-HDDR process, or the low-temperature hydrogenation step, (hydrogen pressure: on the order of 30–200 kPa), hydrogen sufficiently occludes the RFeB-type alloy. Following that, in the second step, or the high-temperature hydrogenation step, (hydrogen pressure: on the order of 20–100 kPa), hydrogen and the RFeB-type alloy react slowly. At this time, the crystals of the $Fe_2B$ phase, which is the anisotropy direction transcription phase, precipitate predominantly uni-axially, and at the same time hydrogen and the B-rich phase react sufficiently. In the third step, or the first evacuation step, while the $Fe_2B$ crystal direction remains the same, RFeB crystals precipitate, and the B-rich phase precipitates finely and densely. Through this densely precipitated B-rich phase, the RFeB crystal grain growth is pinned, and the RFeB crystal grains become very fine. In the fourth and last step, or the second evacuation step, the remaining hydrogen in the alloy is removed.

Especially important points here are that in the high-temperature hydrogenation step, the $Fe_2B$ phase crystal direction is precipitated predominantly on a single axis, and subsequently in the first evacuation step that while the $Fe_2B$ phase crystal direction is maintained the RFeB crystals are finely precipitated due to the effects of the pinning of the fine, densely precipitated B-rich phase. It is through this that high-iHc anisotropic magnet powder is obtained.

When any of the above-mentioned processes are carried out, ingot can be used as the raw material alloy, however if coarsely ground powder is used advances can be made in the efficiency of various steps. The ingot crushing or the powderization carried out after the above-mentioned processing can be carried out in a dry or wet mechanical crusher, etc. (jaw crusher, disc mill, ball mill, vibrating mill, jet mill, etc.).

(c) Degree of Fluidity and Apparent Density

With regards to the magnet alloy of the present invention, the magnet powder obtained by carrying out the above-mentioned HDDR process or d-HDDR process has almost spherical shaped grain diameter. Because of this, the pellets produced using the magnet powder of the present invention have a small degree of fluidity and a large apparent density, unlike the ones produced by the melt-spun method of Prior Technologies 1 and 2 which have a ribbon shape. As a result of this, during the production of bonded magnets, which is the most important application of magnet powder, the insertion of the pellets into the molding die is made easy. Furthermore, because the average grain diameter of the magnet powder of the present invention is moderately large on the order of 50–200 $\mu$m, not only are the above-mentioned degree of fluidity and apparent density improved, but also adhesion, cohesion, etc. can be suppressed, leading to superior processing characteristics. As a result, the mass-producability, quality, yield, etc. of the bonded magnet, etc. are improved and the cost reduction of the various types of magnets can be seen.

To describe this in more detail, when the above-mentioned magnet powder and organic resin binder of 10–45 mass % are mixed, the degree of fluidity of the resulting pellets are 0.55–0.64 (s/g) and the apparent density is 3.25–3.5 (g/cm3). Furthermore, it is desirable if the above-mentioned magnet powder is mixed with organic resin in the amount of 10–25 mass % for compression molding use, 30–45 mass % for injection molding use, and 20–35 mass % for extrusion molding use pellets.

Incidentally, the above-mentioned magnet powder grain diameter is nearly spherical due to the following reasons. When producing magnet powder by using the HDDR process or d-HDDR process, the resulting powder shape is influenced largely by the size of the alloy structure before that processing. During the beginning of the hydrogenation step of HDDR or the low-temperature hydrogenation step of d-HDDR, if the alloy is occluded with hydrogen and the volume swells, resulting in fracture at weak crystal grain boundaries.

In the case of cast magnet alloys such as ingot, the crystal structure in the center is a equiaxed crystal shape, while the crystal structure on the surface is a dendrite shape. In the case of the present invention, with the existence of the B-rich phase, and the control of the precipitation or coming out of grains of the primary crystal $\alpha$-Fe, the dendrite crystal structure formed on the surface becomes fine. As a result, when HDDR process or d-HDDR process is carried out on the cast body made from the magnet alloy of the present invention, nearly round particles generally made of a single crystal grain are obtained from the center of the cast body, and nearly round particles made from a number of dendrite crystals are obtained from the surface. In this manner, the structural grains of the magnet powder are much closer to having a spherical shape compared to the magnet powder obtained from the melt-spun method, etc. used up until now.

(2) Bonded Magnet and its Production Method

Using a magnet powder like the obtained in the above-mentioned text, will result in not only superior magnetic characteristics, but also reduced bonded magnet mass-production costs due to the superior characteristics of the powder when inserted in the mold.

This bonded magnet is obtained by carrying out a mixing step, where the above-mentioned isotropic magnet powder or anisotropic magnet powder is mixed with a binder, and a formation step, where the mixed powder obtained from the mixing step is formed. The binder can be a binder like the above-mentioned organic binder, a metal binder, etc. Organic binders such as resin binders, etc. are the most common. The resins used in resin binders can be a thermo-setting resin or a thermo-plastic resin. If this type of resin binder is used, in addition to the above-mentioned mixing step, it is good to carry out a kneading step where the magnet powder and resin binder are kneaded. The above-mentioned molding step can be compression molding, injection molding, extrusion molding, etc. In the case that anisotropic magnet powder is used for the magnet powder, the anisotropic magnet powder should be formed in a magnetic field. Furthermore, in the case of using heat-hardening resin as the resin binder, a heating (curing) step should be carried out during or after the formation step.

(3) Addition of La-type Material

As mentioned above, La has the highest oxidation potential of the rare-earth elements and it was discovered that therefore magnet powder and hard magnets including La have superior corrosion resistance, etc. due to the control of this oxidation. This form of La addition can be thought to take, for example, the following three forms.

① La-type material is added in the casting step, and production of magnet powder, etc. is carried out using La-containing RFeB-type magnet alloy (ingot)

② Mixing La-type material with RFeB-type magnet powder obtained through the HDDR process or d-HDDR process, where the La is diffused into or coats the magnet powder ③ Mixing La-type material with RFeB-type hydride (RFeBHx) during the formation of the magnet powder, where the La is diffused into or coats the hydride.

No matter which way is used, as long as La exists in addition to the above-mentioned R, an improvement in the corrosion resistance, etc. of the magnet powder or hard magnet will be shown, and there are no problems within the scope of the present invention regarding the form that the La addition takes, etc.

It must also be said, looking from the point of view of even more effective control of the oxidation of magnet powder, etc. which has La, which has an oxygen-getter function, that it is even more favorable if the La exists on the surface of, or in the vicinity of, the magnet powder structural grains, etc. Consequently, rather than having La included initially in the magnet alloy, it is more advantageous to have La diffuse, etc. into, or onto the surface of, the magnet powder by mixing in La-type material during or after the production of the magnet powder.

For example in the case of the production method of the above-mentioned isotropic magnet powder, La-mixed material, formed by mixing La-type material made from one or more of La simple substance, La alloy or La compound, can be used to diffuse La into or onto the surface of the above-mentioned magnetic powder in a diffusion heat step carried out at 673–1123 K, and it is ideal to have 0.001–1.0 at % La content per 100 at % of resulting isotropic magnet powder.

One can also think to mix a La-type material with the RFeBHx powder, etc. that exists in the middle of the production of the magnetic powder, where the La diffuses, etc. into the surface or the middle of the powder. The R and Fe of this RFeBHx powder, etc. are extremely difficult to oxidize when compared to RFeB-type powder, etc. Because of this, La diffusion or coating takes place in a state with controlled oxidation, resulting in a magnet powder with superior corrosion resistance, etc. and a stable product. Incidentally, this hydride (RFeBHx), whose polycrystals are recrystallized by transcription along the crystal direction of $Fe_2B$, is obtained after the first evacuation step of the d-HDDR process when the hydrogen is removed from the $RH_2$ phase that was decomposed from the ternary phase in the hydrogenation step.

Therefore, in the production method of the anisotropic magnet powder of the present invention the above-mentioned first evacuation step is followed by a diffusion heat treatment step wherein La is diffused into the surface or center of said RFeB hydride by heating a La-mixture made from the RFeB-type hydride obtained after above-mentioned first evacuation step and a La-type material containing more than one of La simple structure, La alloy, La compound or its hydride at 673–1123 K, where the removal of hydrogen of above-mentioned second evacuation step is carried out on the La-processed material after said diffusion heat treatment step, or where said second evacuation step is carried out simultaneously with the diffusion heat treatment step, or where the diffusion heat treatment step is carried out after the second evacuation step. It is suitable to have the La content of anisotropic magnet powder obtained by this type of method be 0.001–1.0 at % per 100 at %.

Diffusion (or coating) of La into the surface or center or the RFeB-type magnet powder or RFeB-type hydride occurs in the diffusion heat treatment step. This diffusion heat treatment step can be carried out after mixing with La-type material, or simultaneously with that mixing. If the processing temperature is less than 673 K, the diffusion process becomes difficult, as it is difficult for the La-type material to become a liquid phase. On the other hand, if above 1123 K, with the crystal grain growth of the RFeB-type magnet powder, etc., sufficient improvement of the corrosion resistance, etc. (decrease of the permanent demagnetization ratio) cannot be achieved with the decrease in iHc. A duration of 0.5–5 hours for this processing time is ideal. If less than 0.5 hours, the La diffusion will be insufficient, and the corrosion resistance, etc. of the magnet powder will not be much improved. On the other hand, if greater than 5 hours, a decrease in iHc will be induced. As we all know, it is preferable that this diffusion heat treatment step be carried out in an atmosphere where oxidation is prevented (such as in a vacuum atmosphere). The La-type material, as said above, can take any form. From the viewpoint of increasing the reliability and effectiveness of the processing steps of magnet powder, it is desirable that it be in a powder state. Alloys or compounds (including inter-metallic compounds) with La and transition metals (TM) are desirable as La alloy or La compounds. For example, LaCo, LaNdCo, LaDyCo, etc. can be used. Co is especially suitable because of the obtained high Curie temperature of the magnet powder.

B. Examples

The following examples are offered so as to explain the present invention in detail.

Example 1, Example 2

(1) Production of Alloy, Magnet Powder and Bonded Magnet

As an example of the magnet alloy of the present invention, the ingots (magnet alloys) with the compositions of samples 1–10 as shown in Tables 1 and 2 were produced by melting and casting. Furthermore, as a comparison, ingots with the compositions C1–C6 produced by melting and casting are provided in each table. The produced ingots were each on the order of 30 kg.

The alloy composition of the various samples shown in Tables 1 and 2 are all identical. However, in Tables 1 and 2, the processing of the various samples (ingots) is different. That is to say, in Table 1 each of the samples subjected to HDDR processing, and the magnet powder shown in Table 1 is isotropic magnet powder obtained by carrying out that processing. The bonded magnets shown in Table 1 are produced from that isotropic magnet powder. Example 1 is as follows.

In Table 2, each sample has been subjected to d-HDDR processing, and the magnet powder shown in Table 2 is anisotropic magnet powder obtained through that processing. The bonded magnets shown in Table 2 are produced from that anisotropic magnet powder. Example 2 is as follows.

The following is a detailed introduction to the production conditions of the magnet powder and bonded magnets shown in Tables 1 and 2.

① The magnet powder shown in Table 1 is produced by carrying out HDDR processing consisting of the hydrogenation and desorption steps, without carrying out the homogenizing heat step, on the ingot with alloy composition of samples No. 1–10 and C1–C6. That is to say, heat treatment (hydrogenation step) was carried out for 360 minutes under a hydrogen atmosphere at the temperature and hydrogen pressure shown in Table 1. Following this, a vacuum is created by a rotary pump or diffusion pump, and cooling (desorption step) is carried out for 60 minutes under vacuum of $10^{-1}$ Pa. In this way, batches of magnet powder on the order of 10 kg were produced.

② The magnet powder shown in Table 2 is produced by the d-HDDR processing consisting of a low-temperature hydrogenation step, high-temperature hydrogenation step, first evacuation step and second evacuation step, without carrying out the homogenizing heat step, on the ingot with alloy composition of samples No. 1–10 and C1–C6. That is to say, sufficient absorption of hydrogen (low-temperature hydrogenation step) was carried out on each alloy sample under a hydrogen atmosphere of 100 kPa hydrogen pressure at each temperature. Next, heat treatment (high-temperature hydrogenation step) was carried out for 480 minutes under a hydrogen atmosphere at the temperatures and hydrogen pressures shown in Table 2. Following this, heat treatment (first evacuation step) was carried out for 160 minutes under a hydrogen atmosphere of 0.1–20 kPa hydrogen pressure and the same temperature as shown in Table 2. Finally, a vacuum is created by a rotary pump or diffusion pump, and cooling (second evacuation step) is carried out for 60 minutes under vacuum of $10^{-1}$ Pa. In this way, batches of magnet powder on the order of 10 kg were produced.

③ Next, the following kind of bonded magnets are produced using the various types of isotropic magnet powders shown in Table 1 and the anisotropic magnet powders shown in Table 2 obtained as mentioned above.

First, each magnet powder is mixed with epoxy resin (3 wt %) dissolved beforehand in 2-butanone. Then bonded-magnet-use pellets are produced by volatilizing the 2-butanone under a vacuum. As a reference sample, the same kind of pellets were made with a raw material of the ribbon shaped MQP-B (made by Magnequench International) made by the melt spinning method. Then the pellets were aligned under a 2.5 T magnetic field, and made into cubic bonded magnets, which has 7 mm side, by compression molding.

(2) Magnetic Measurement of the Magnet Powder and Bonded Magnet

① Magnetic measurement was carried out for the various obtained magnet powders. For the measurement of iHc, an ordinary BH tracer could not be used, so the iHc was measured in the following way. First, the magnet powder is classified into grain diameter between 75–106 $\mu$m. Using this classified magnet powder, (BH)max and iHc are measured after forming so as to achieve a demagnetization coefficient of 0.2 and after magnetization at 4.57 $MAm_{-1}$ after alignment in a magnetic field. These results are brought together and shown in Tables 1 and 2.

② Additionally, the (BH)max and iHc of the various obtained bonded magnets were measured with a BH tracer (made by Riken Electronic Sales Corporation, BHU-25). These results are brought together and shown in Tables 1 and 2.

The "–" As in Tables 1 and 2 indicate when the magnetic properties could not be measured because they were too low.

(3) Evaluation

① To give a general overview of Tables 1 and 2, when the amount of B is less than 10.8 at %, as in samples No. C1, C2, C4 and C5, the (BH)max and iHc decrease drastically. Moreover, when the B is greater than 15 at %, as in samples No. C3 and C6, (BH) max is decreased.

When the amount of B is less than 10.8 at %, the decrease in iHc is thought to be due to the precipitation of $\alpha$-Fe. When B is greater than 15 at %, the decrease in (BH)max is thought to be due to the increase in B-rich phase.

Accordingly, it is preferable to keep the amount of B between 10.8–15 at % as in the present invention in order to keep a balance between high (BH)max and high iHc. Next, the isotropic magnet powder and bonded magnets of Table 1, as well as the anisotropic magnet powder and bonded magnets of Table 2, will be investigated in detail.

② Isotropic Magnet Powder and Bonded Magnet

By comparing the actual examples shown in Table 1 (samples No. 1 and 2) and the comparison examples (samples No. C1–C3), the ternary isotropic powder obtained by carrying out HDDR of the same conditions on alloy ingots differing only in B composition can be understood.

As in the comparison examples where the amount of B is too little or too much, to be exact, if the amount of B is outside of the range of 10.8–15 at %, the maximum energy product (BH)max of the magnet powder is decreased. In contrast, in the actual examples where the amount of B is within this range, a large (BH)max of not less than 70 $kJm^{-3}$ is obtained. In this way, the peak values for (BH) max can exist in the range B: 10.8–15 at %.

Magnet powder coercivity iHc shows a tendency to increase along with an increase in amount of B. When the amount of B is in the range of not less than 10.8 at %, the tendency of iHc addition is very moderate, but sufficient iHc is obtained for a B amount of 10.8–15 at %.

By comparing the actual example shown in Table 1 (sample No. 5) and the comparison examples (samples No. C4–C6), the same as mentioned above can be said about hexadic isotropic powder obtained by carrying out HDDR of the same conditions on alloy ingots differing only in B composition. That is to say that the peak (BH)max values are obtained in the range B: 10.8–15 at % and the iHc values obtained in that range are also close to the peak values.

The same can be said when the isotropic magnet powder is made into a bonded magnet for both the tertiary and hexadic compositions.

Furthermore, from Table 1 it can be understood that the bonded magnets of the actual examples that have a higher order than 6, have a (BH)max on the same order as that of the bonded magnets made from MQP-B, and the iHc is about 50% improved.

③ Anisotropic Magnet Powder and Bonded Magnet

By comparing the actual examples shown in Table 2 (samples No. 1 and 2) and the comparison examples (samples No. C1–C3), the ternary anisotropic powder obtained by carrying out d-HDDR of the same conditions on alloy ingots differing only in B composition can be understood.

As in the comparison examples where the amount of B is too little or too much, to be exact, if the amount of B is outside of the range of 10.8–15 at %, the maximum energy product (BH)max of the magnet powder is decreased. In contrast, in the actual examples where the amount of B is within this range, a large (BH)max of not less than 210 $kJm^{-3}$ is obtained. In this way, the peak values for (BH)max can exist in the range B: 10.8–15 at %.

Magnet powder coercivity iHc shows a tendency to increase along with an increase in amount of B. When the amount of B is in the range of not less than 10.8 at %, the tendency of iHc addition is very moderate, but sufficient iHc is obtained for a B amount of 10.8–15 at %.

By comparing the actual example shown in Table 2 (sample No. 5) and the comparison examples (samples No. C4–C6), the same as mentioned above can be said about hexadic anisotropic powder obtained by carrying out d-HDDR of the same conditions on alloy ingots differing only in B composition. That is to say that the peak (BH)max values are obtained in the range B: 10.8–15 at % and the iHc values obtained in that range are also close to the peak values.

The same can be said when the anisotropic magnet powder is made into a bonded magnet for both the tertiary and hexadic compositions.

Example 3

The relationship between the intrinsic coercivity of the isotropic magnet powder obtained by carrying out HDDR processing on ingot samples No. 2 and 6 as shown in Table 1, and the duration (180–1800 minutes) of the hydrogenation step of the HDDR process, was investigated. Except for the duration of the hydrogenation step, the production conditions of the various magnet powders are the same as those in the HDDR process explained in Example 1. In addition, the magnetic property measurement methods are the same as those in Examples 1 and 2. The results obtained are shown in Table 3.

From Table 3 it can be understood that iHc increases with an increase in duration of the hydrogenation step, and that the increase of iHc has a tendency to saturate beyond 360 minutes.

Example 4

The relationship between the intrinsic coercivity iHc of the anisotropic magnet powder obtained by carrying out d-HDDR processing on the ingot samples No. 2 and 6 as shown in Table 2, and the duration (180–1800 minutes) of the high-temperature hydrogenation step of the d-HDDR process, was investigated.

Except for the duration of the high-temperature hydrogenation step, the production conditions for the various magnet powders are the same as those of the d-HDDR processing introduced in Example 2. Furthermore, the magnetic property measurement method is the same as that of Examples 1 and 2. The results obtained are shown in Table 4.

From Table 4 it can be understood that, just as in Example 3, when the processing duration of the high-temperature hydrogenation step exceeds 360 minutes, the resulting coercivity has a tendency to saturate.

Example 5

The fluidities and apparent densities of bonded-magnet-use pellets made from isotropic magnet powder of samples No. 5–8 as shown in Table 1, anisotropic magnet powder of samples No. 1–4 as shown in Table 2, and the reference sample (MQP-B), were investigated. The measurement results are shown in FIGS. 1 and 2.

The degree of fluidity and apparent density of the pellets were measured according to JIS Z8041 (JIS standards).

Figure 2:
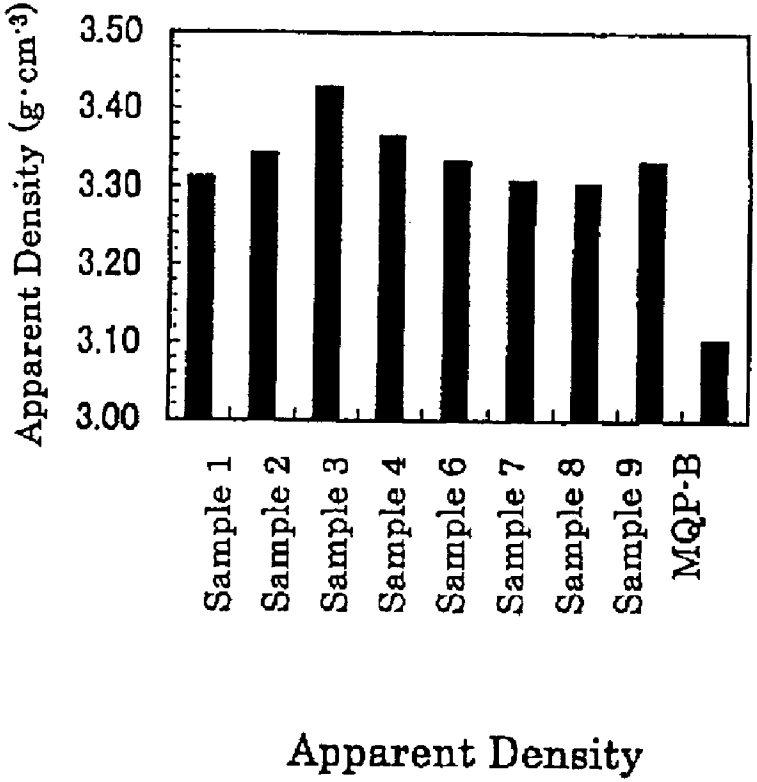
FIG. 2 shows a bar graph comparison of the apparent densities of bonded-magnet-use pellets made from various magnet powders.

It can be understood from FIGS. 1 and 2, that the Actual Examples have about 20% improved degree of fluidity and 10% improved apparent density when compared to the reference sample. It is thought that this is because the grain shape of the various magnet powders of the Actual Examples is close to spherical.

Example 6

The cost performance of the anisotropic magnet powder obtained from carrying out d-HDDR processing on alloy ingot sample No. 6 of Table 2, was investigated.

First, ingot sample No. 6 (on the order of 30 kg) was made by melting and casting. This ingot was subject to sufficient hydrogen absorption (low-temperature hydrogenation step) under a hydrogen atmosphere at a hydrogen pressure of 100 kPa and room temperature, without carrying out homogenizing heat treatment. Next, heat treatment (high-temperature hydrogenation step) was carried out for 480 minutes at 1073 K and a hydrogen pressure of 45 kPa under a hydrogen atmosphere. Following that, heat treatment (first evacuation step) was carried out for 160 minutes at 1073 K and 0.1–10 kPa hydrogen pressure under a hydrogen atmosphere. Finally, under a vacuum created by a rotary pump or diffusion pump, cooling (second evacuation step) was carried out for 60 minutes under $10^{-1}$ Pa vacuum pressure. In this manner, batches on the order of 10 kg of magnet powder were produced.

Using this magnet powder, bonded magnets were made in the same manner as in Examples 1 and 2, and the (BH)max was measured. Then the cost performance, the measured (BH)max divided by the d-HDDR raw material cost (raw material costs, melting and casting costs) was shown in FIG. 3.

As a comparative sample, the alloy ingot CI (on the order of 30 kg) of Table 2 was made by melting and casting. This ingot was subjected to a homogenizing heat treatment step, maintained for 40 hours at a temperature of 1413 K in an argon atmosphere. After that, it d-HDDR was carried out under the same conditions as those of the above-mentioned sample 6. In this manner, batches of magnet powder on the order of 10 kg were produced.

In the same manner as in the above-mentioned sample 6, this magnet powder was used to make bonded magnets, and their (BH)max were measured. Then the cost performance, the measured (BH)max divided by the d-HDDR raw material cost (raw material costs, melting and casting costs) was shown in FIG. 3.

Figure 3:
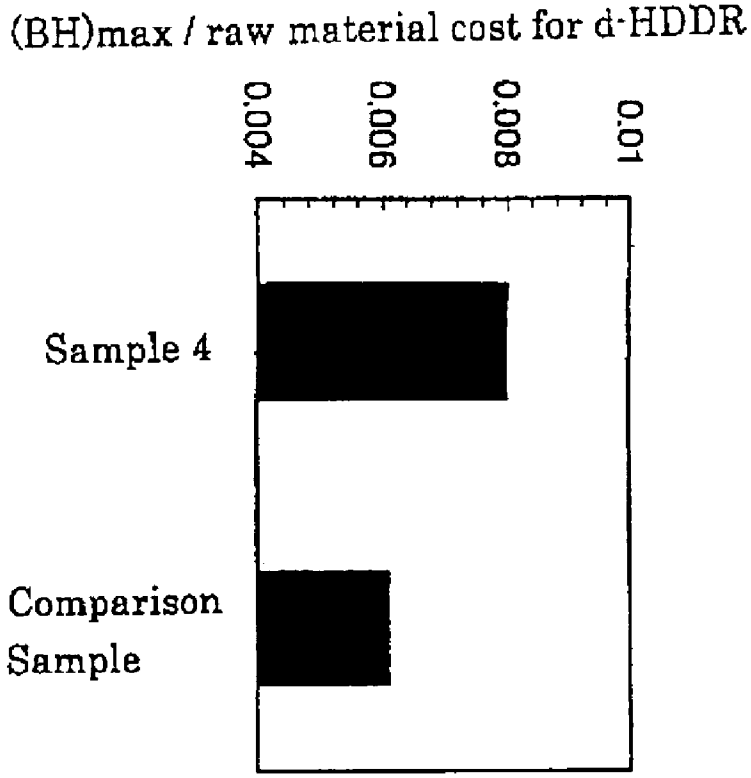
FIG. 3 shows a bar graph comparison of the cost performance of magnet powders produced using the d-HDDR process

From FIG. 3, it can be seen that the cost performance of sample 4, where no homogenizing heat treatment was carried out, is on the order of 30% higher than sample C1, where a homogenizing heat treatment was carried out.

Example 7

(1) Isotropic powder was produced from the alloy ingots of sample No. 1 and No. 6 of Table 1, by carrying out the HDDR under the same conditions as that of Actual Example 1. Magnet powder samples No. 11–15 and samples No. 16, 17 as shown in Tables 5 and 6 were obtained by mixing (mixing step) this magnet powder with La80Co20 alloy powder, and heating (diffusion heat treatment step). The compositions of the various samples shown in Tables 5 and 6 are values from ICP (high-frequency plasma radiation analysis device) analysis after the diffusion heat treatment step. The diffusion heat treatment conditions for all of the each of the various samples are shown in Table 5. The diffusion heat treatment conditions for Table 6 are all 1073 K for 1 hour. The above-mentioned mixing step as well as the diffusion heat treatment step were all carried out under a vacuum atmosphere of $10^{-2}$ Pa. As one example, in Table 6, the magnetic properties of the isotropic magnet powder of samples No. 16, 17 and their bonded magnets are shown. The measurement methods, etc. are the same as those stated above.

Here, the La80Co20 alloy is an alloy with La: 80 at % and Co: 20 at %, which is cast in the same manner as the magnet alloy (ingot) of Actual Example 1. This powder is made by crushing this ingot by a hydrogen crushing method, and using a vibration mill to make the powder finer, and it has an average grain diameter of 10 $\mu$m.

A cubic isotropic bonded magnet which has 7 mm sides, was made using the isotropic magnet powder after the diffusion heat treatment step, in the same manner as Example 1.

The permanent demagnetization ratio is the ratio of a bonded magnet's initial magnetic flux and the difference between the initial magnetic flux and the magnetic flux after remagnetization after being held for 1000 hours in an air atmosphere at 100° C. or 80° C. Here the magnetization is carried out at 1.1 MA/m (45 kOe). A fluxmeter was used to measure the magnetic flux. The permanent demagnetization ratios gathered in this manner are brought together in Tables 5 and 6.

(2) For comparison, bonded magnets were prepared from samples No. C7–C9 of Table 5. The sample No. C7 bonded magnet has more than 1.0 at % of La amount, and the sample No. C8 bonded magnet is not mixed with La-type material, while the heating temperature of the diffusion heat treatment step of the sample No. C9 bonded magnet was reduced to less than 400° C. The diffusion heat treatment conditions and the permanent demagnetization ratios of the various samples are shown in Table 5.

(3) From Tables 5 and 6 it can be understood that the isotropic bonded magnet of the present invention has a low permanent demagnetization ratio, and has great potential for actual use in terms of heat resistance. A low permanent demagnetization ratio means superior heat-resistance characteristics and low loss with time.

The permanent demagnetization ratio of 100° C. for 1000 hours is particularly low at less than 10%. The permanent demagnetization ratio of 80° C. for 1000 hours is about 5% smaller.

On the other hand, if one looks at the comparison example, the permanent demagnetization ratio of 80° C. for 1000 hours is about 10% higher, and the permanent demagnetization ratio of 100° C. for 1000 hours is especially large at nearly 15% higher. Incidentally, as a reference sample, the permanent demagnetization ratio of isotropic powder made by quenching solidification (MQP-B) is shown in Table 5.

Other than that, the magnet powder and bonded magnet's magnetic characteristics are the same, or at most on the order of 7–8% reduced, from the results of the Examples shown in Table 1, and there is no problem in using them in practical application.

Example 8

(1) NdFeBH×powder was obtained by carrying out a low-temperature hydrogenation step, high-temperature hydrogenation step and first evacuation step in the same manner as in Example 2, to alloy ingot samples No. 1 and No. 6 of Table 2. This NdFeBHX powder was mixed (mixing step) with La80Co20 alloy powder, and heated (diffusion heat treatment step) in the same manner as in Example 7. Following this, the second evacuation step was carried out in the same manner as in Example 2.

In this manner, the samples No. 11–15 and samples No. 16, 17 shown in Tables 6 and 7 were obtained. The compositions of the various samples shown in Tables 6 and 7 are, as in Example 7, the values of ICP analysis after the second evacuation step. In addition, the diffusion heat treatment conditions for all of the various samples are shown in Table 7. The diffusion heat treatment conditions for Table 8 are all 1073 K for 1 hour. The above-mentioned mixing step as well as diffusion heat treatment step are carried out in a vacuum atmosphere of $10^{-2}$ Pa. As one example, in Table 8, the magnetic properties of the anisotropic magnet powder of samples No. 16, 17 and their bonded magnets are shown. The measurement methods, etc. are the same as those stated above.

Therefore, similar to Actual Example 7, the desired permanent demagnetization ratios are shown in Tables 7 and 8.

(2) Comparison Example bonded magnets were prepared in the same manner as in Example 7. The respective diffusion heat treatment conditions and permanent demagnetization ratios are shown in Table 7.

(3) From Tables 7 and 8 it can be seen that the anisotropic bonded magnets of the present invention have small permanent demagnetization ratios and a high evaluation for practical use. The permanent demagnetization ratio of 100° C. for 1000 hours is particularly low at less than 10%. The permanent demagnetization ratio of 80° C. for 1000 hours a small 5–7%. On the other hand, if one looks at the comparison example, the permanent demagnetization ratio of 80° C. for 1000 hours is high, not less than 10%, and the permanent demagnetization ratio of 100° C. for 1000 hours is especially high, not less than 15%.

Other than that, the magnet powder and bonded magnet's magnetic characteristics are the same, or at most on the order of 7–8% reduced, from the results of the Actual Examples shown in Table 2, and there is no problem in using them in practical application.

TABLE 1

| | | Isotropic | | | | | |
|---|---|---|---|---|---|---|---|
| | | Magnetic properties | | | | HDDR process condition | |
| | | Magnet powder | | Bonded magnet | | | Hydrogen |
| Sample No. | Alloy composition (at %) | (BH)max ($kJm^{-3}$) | iHc ($MAm^{-1}$) | (BH)max ($kJm^{-3}$) | iHc ($MAm^{-1}$) | Temperature (K) | pressure (kPa) |
| Examples | | | | | | | |
| 1 | $Nd_{12.5}Fe_{bal.}B_{10.8}$ | 75 | 0.89 | 54 | 0.88 | 273 | 100 |
| 2 | $Nd_{12.5}Fe_{bal.}B_{12.0}$ | 70 | 0.93 | 51 | 0.90 | 273 | 100 |
| 3 | $Nd_{12.5}Pr_{0.1}Dy_{0.1}Fe_{bal.}B_{15.0}$ | 64 | 1.05 | 56 | 1.03 | 273 | 100 |
| 4 | $Nd_{12.5}Fe_{bal.}Co_3B_{12.0}$ | 76 | 0.92 | 56 | 0.90 | 273 | 100 |
| 5 | $Nd_{12.5}Fe_{bal.}Co_5Ga_{0.3}Nb_{0.2}Cu_{0.1}B_{10.8}$ | 90 | 1.45 | 65 | 1.45 | 273 | 100 |
| 6 | $Nd_{12.5}Fe_{bal.}Co_5Ga_{0.3}Nb_{0.2}B_{12.0}$ | 88 | 1.48 | 66 | 1.46 | 273 | 100 |
| 7 | $Nd_{12.5}Fe_{bal.}Co_5Ga_{0.2}Al_{0.1}Nb_{0.2}B_{15.0}$ | 78 | 1.49 | 60 | 1.49 | 273 | 100 |
| 8 | $Nd_{11.3}Pr_{0.6}Fe_{bal.}Co_5Ga_{0.2}Zr_{0.1}Nb_{0.2}B_{15.0}$ | 78 | 1.42 | 57 | 1.41 | 273 | 100 |
| 9 | $Nd_{12.5}Dy_{0.5}Fe_{bal.}Ga_{0.3}Nb_{0.1}Ni_{0.1}B_{12.0}$ | 80 | 1.57 | 58 | 1.57 | 273 | 100 |
| 10 | $Nd_{12.5}Pr_{2.0}Dy_{1.0}Fe_{bal.}Co_5B_{12.0}$ | 74 | 1.63 | 54 | 1.62 | 273 | 100 |
| Comparison Examples | | | | | | | |
| C1 | $Nd_{12.5}Fe_{bal.}B_{6.4}$ | 3 | 0.22 | — | — | 273 | 100 |
| C2 | $Nd_{12.5}Fe_{bal.}B_9$ | 47 | 0.44 | 32 | 0.41 | 273 | 100 |
| C3 | $Nd_{12.5}Fe_{bal.}B_{17.0}$ | 58 | 1.00 | 41 | 0.99 | 273 | 100 |
| C4 | $Nd_{12.5}Fe_{bal.}Co_5Ga_{0.3}Nb_{0.2}B_{6.4}$ | 4 | 0.40 | — | — | 273 | 100 |
| C5 | $Nd_{12.5}Fe_{bal.}Co_5Ga_{0.3}Nb_{0.2}B_9$ | 51 | 0.57 | — | — | 273 | 100 |
| C6 | $Nd_{12.5}Fe_{bal.}Co_5Ga_{0.3}Nb_{0.2}B_{17}$ | 62 | 1.60 | 43 | 1.61 | 273 | 100 |
| Reference Sample | MQP-B | — | — | 64 | 0.96 | — | — |

TABLE 2

| | | Anisotropic | | | | | |
|---|---|---|---|---|---|---|---|
| | | Magnetic properties | | | | d-HDDR process conditions | |
| | | Magnet powder | | Bonded magnet | | | Hydrogen |
| Sample No. | Alloy Composition (at %) | (BH)ma × ($kJm^{-3}$) | iHc ($MAm^{-1}$) | (BH)ma × ($kJm^{-3}$) | iHc ($MAm^{-1}$) | Temperature (K) | pressure (kPa) |
| Examples | | | | | | | |
| 1 | $Nd_{12.5}Fe_{bal.}B_{10.8}$ | 220 | 0.88 | 112 | 0.87 | 273 | 30 |
| 2 | $Nd_{12.5}Fe_{bal.}B_{12.0}$ | 210 | 0.90 | 115 | 0.88 | 273 | 30 |
| 3 | $Nd_{12.5}Pr_{0.1}Dy_{0.1}Fe_{bal.}B_{15.0}$ | 192 | 1.03 | 101 | 1.01 | 273 | 40 |
| 4 | $Nd_{12.5}Fe_{bal.}Co_3B_{12.0}$ | 224 | 0.90 | 114 | 0.88 | 273 | 40 |
| 5 | $Nd_{12.5}Fe_{bal.}Co_5Ga_{0.3}Nb_{0.2}Cu_{0.1}B_{10.8}$ | 260 | 1.42 | 144 | 1.40 | 273 | 40 |
| 6 | $Nd_{12.5}Fe_{bal.}Co_5Ga_{0.3}Nb_{0.2}B_{12.0}$ | 264 | 1.45 | 146 | 1.44 | 273 | 40 |
| 7 | $Nd_{12.5}Fe_{bal.}Co_5Ga_{0.2}Al_{0.1}Nb_{0.2}B_{15.0}$ | 232 | 1.46 | 140 | 1.45 | 273 | 40 |
| 8 | $Nd_{11.3}Pr_{0.6}Fe_{bal.}Co_5Ga_{0.2}Zr_{0.1}Nb_{0.2}B_{15.0}$ | 234 | 1.39 | 140 | 1.37 | 273 | 50 |
| 9 | $Nd_{12.5}Dy_{0.5}Fe_{bal.}Ga_{0.3}Nb_{0.1}Ni_{0.1}B_{12.0}$ | 240 | 1.55 | 145 | 1.53 | 273 | 50 |
| 10 | $Nd_{12.5}Pr_{2.0}Dy_{1.0}Fe_{bal.}Co_5B_{12.0}$ | 230 | 1.60 | 135 | 1.58 | 273 | 70 |
| Comparison Examples | | | | | | | |
| C1 | $Nd_{12.5}Fe_{bal.}B_{6.4}$ | 10 | 0.21 | — | — | 273 | 30 |
| C2 | $Nd_{12.5}Fe_{bal.}B_9$ | 140 | 0.42 | 69 | 0.40 | 273 | 30 |
| C3 | $Nd_{12.5}Fe_{bal.}B_{17.0}$ | 175 | 0.98 | 94 | 0.97 | 273 | 30 |
| C4 | $Nd_{12.5}Fe_{bal.}Co_5Ga_{0.3}Nb_{0.2}B_{6.4}$ | 16 | 0.46 | — | — | 273 | 40 |
| C5 | $Nd_{12.5}Fe_{bal.}Co_5Ga_{0.3}Nb_{0.2}B_9$ | 152 | 0.58 | — | — | 273 | 40 |
| C6 | $Nd_{12.5}Fe_{bal.}Co_5Ga_{0.3}Nb_{0.2}B_{17}$ | 158 | 1.58 | 121.6 | 1.57 | 273 | 40 |

TABLE 3

| Sample No. | Hydrogenation Step (minutes) | iHo ($MAm^{-1}$) |
|---|---|---|
| Sample 2 | 180 | 0.41 |
| | 360 | 0.93 |
| | 540 | 0.93 |
| | 1800 | 0.95 |
| Sample 6 | 180 | 0.88 |
| | 360 | 1.48 |
| | 540 | 1.50 |
| | 1800 | 1.52 |

TABLE 4

| Sample No. | High-temperature hydrogenation step (minutes) | iHo ($MAm^{-1}$) |
|---|---|---|
| Sample 2 | 180 | 0.40 |
| | 360 | 0.78 |
| | 480 | 0.90 |
| | 1800 | 0.94 |
| Sample 6 | 180 | 0.87 |
| | 360 | 1.39 |
| | 480 | 1.46 |
| | 1800 | 1.50 |

TABLE 5

| | | Isotropic bonded magnet | | | |
|---|---|---|---|---|---|
| | | Diffusion heat treatment condition | | Permanent demagnetization ratio (%) | |
| Sample No. | Alloy composition (at %) | Temperature (K) | Time (hr) | 353K × 1000 hr | 373K × 1000 hr |
| Examples | | | | | |
| 11 | $Nd_{12.4}La_{0.2}Fe_{bal.}B_{11.0}$ | 1073 | 1 | 7.2 | 9.5 |
| 12 | $Nd_{12.3}La_{0.23}Fe_{bal.}Co_5Ga_{0.3}Nb_{0.2}B_{12.2}$ | 1073 | 1 | 4.8 | 6.3 |
| 13 | $Nd_{12.0}La_{0.5}Fe_{bal.}Co_5Ga_{0.3}Nb_{0.2}B_{12.0}$ | 1073 | 1 | 6.6 | 8.7 |
| 14 | $Nd_{12.3}La_{0.1}Fe_{bal.}Co_5Ga_{0.3}Nb_{0.2}B_{12.1}$ | 1053 | 3 | 5.1 | 9.4 |
| 15 | $Nd_{12.3}La_{0.15}Fe_{bal.}Co_5Ga_{0.3}Nb_{0.2}B_{12.3}$ | 1093 | 1 | 5.0 | 8.9 |
| Comparison Examples | | | | | |
| C7 | $Nd_{11.3}La_{1.5}Fe_{bal.}Co_5Ga_{0.3}Nb_{0.2}B_{11.8}$ | 1073 | 1 | 11.6 | 15.4 |
| C8 | $Nd_{12.5}Fe_{bal.}Co_5Ga_{0.3}Nb_{0.2}B_{12.0}$ | 1073 | 1 | 9.6 | 14.8 |
| C9 | $Nd_{12.3}La_{0.23}Fe_{bal.}Co_5Ga_{0.3}Nb_{0.2}B_{12.1}$ | 573 | 1 | 11.0 | 16.0 |
| Reference Sample | MQP-B | — | — | 4.0 | 6.0 |

TABLE 6

| | | Anisotropic | | | | | |
|---|---|---|---|---|---|---|---|
| | | Magnetic properties | | | | | |
| | | Magnet powder | | Bonded magnet | | Permanent demagnetization ratio (%) | |
| Sample No. | Alloy composition (at %) | (BH)max ($kJm^{-3}$) | iHc ($MAm^{-1}$) | (BH)max ($kJm^{-3}$) | iHc ($MAm^{-1}$) | 353K, 1000 hr | 373K, 1000 hr |
| Examples | | | | | | | |
| 16 | $Nd_{12.2}La_{0.01}Fe_{bal.}Co_5Ga_{0.3}Nb_{0.2}B_{12.0}$ | 89.1 | 1.45 | 80.2 | 1.45 | 6 | 6.9 |
| 17 | $Nd_{12.2}La_{0.5}Fe_{bal.}Co_5Ga_{0.3}Nb_{0.2}B_{12.0}$ | 87.5 | 1.44 | 80.3 | 1.44 | 5.9 | 6.7 |

TABLE 7

| Sample No. | Alloy composition (at %) | Anisotropic bonded magnet: Diffusion heat treatment condition: Temperature (K) | Time (hr) | Permanent demagnetization ratio (%): 353K × 1000 hr | 373K × 1000 hr |
|---|---|---|---|---|---|
| Examples | | | | | |
| 11 | $Nd_{12.4}La_{0.2}Fe_{bal.}B_{11.0}$ | 1073 | 1 | 8.0 | 10.0 |
| 12 | $Nd_{12.3}La_{0.23}Fe_{bal.}Co_5Ga_{0.3}Nb_{0.2}B_{12.2}$ | 1073 | 1 | 5.0 | 7.0 |
| 13 | $Nd_{12.0}La_{0.5}Fe_{bal.}Co_5Ga_{0.3}Nb_{0.2}B_{12.0}$ | 1073 | 1 | 7.0 | 9.0 |
| 14 | $Nd_{12.3}La_{0.1}Fe_{bal.}Co_5Ga_{0.3}Nb_{0.2}B_{12.1}$ | 1053 | 3 | 5.4 | 9.8 |
| 15 | $Nd_{12.3}La_{0.15}Fe_{bal.}Co_5Ga_{0.3}Nb_{0.2}B_{12.3}$ | 1093 | 1 | 5.5 | 9.5 |
| Comparison Examples | | | | | |
| C7 | $Nd_{11.3}La_{1.5}Fe_{bal.}Co_5Ga_{0.3}Nb_{0.2}B_{11.8}$ | 1073 | 1 | 12.2 | 15.8 |
| C8 | $Nd_{12.5}Fe_{bal.}Co_5Ga_{0.3}Nb_{0.2}B_{12.0}$ | 1073 | 1 | 10.0 | 15.0 |
| C9 | $Nd_{12.3}La_{0.23}Fe_{bal.}Co_5Ga_{0.3}Nb_{0.2}B_{12.1}$ | 573 | 1 | 11.2 | 16.1 |

TABLE 8

| Sample No. | Alloy composition (at %) | Anisotropic: Magnetic properties: Magnet powder: (BH)max ($kJm^{-3}$) | iHc ($MAm^{-1}$) | Bonded magnet: (BH)max ($kJm^{-3}$) | iHc ($MAm^{-1}$) | Permanent demagnetization ratio (%): 353K, 1000 hr | 373K, 1000 hr |
|---|---|---|---|---|---|---|---|
| Examples | | | | | | | |
| 16 | $Nd_{12.2}La_{0.01}Fe_{bal.}Co_5Ga_{0.3}Nb_{0.2}B_{12.0}$ | 279.0 | 1.43 | 136.2 | 1.43 | 5.4 | 9.7 |
| 17 | $Nd_{12.2}La_{0.05}Fe_{bal.}Co_5Ga_{0.3}Nb_{0.2}B_{12.0}$ | 278.0 | 1.42 | 130.0 | 1.42 | 5.3 | 9.6 |

What is claimed is:

1. An alloy comprising a main component of iron (Fe);

12–16 atomic % of R, where R is at least one selected from the group consisting of rare-earth elements and yttrium (Y), and 0.01–1.0 atomic % of lanthanum (La) is included in the 12–16 atomic % of R; and 10.8–15 atomic % of boron (B).

2. The alloy according to claim 1, wherein at least one of Pr, Nd and Dy is included in the R.

3. The alloy according to claim 1, further comprising 0.1–6 atomic % of cobalt (Co).

4. The alloy according to claim 1, further comprising at least one of gallium (Ga), zirconium (Zr), vanadium (V), aluminum (Al), titanium (Ti), hafnium (Hf) and copper (Cu) in a total amount of 0.1–2 atomic %; and at least one of niobium (Nb), tantalum (Ta) and nickel (Ni) in a total amount of 0.1–2 atomic %.

5. The alloy according to claim 1, wherein 0.01–0.7 atomic % of La is included in the 12–16 atomic % of R.

6. An isotropic magnet powder made by a HDDR process comprising a hydrogenation step where an alloy comprising a main composition of Fe;

12–16 atomic % of R, where R is at least one selected from the group consisting of rare-earth elements and yttrium (Y), and 0.01–1.0 atomic % of lanthanum (La) is included in the 12–16 atomic % of R; and 10.8–15 atomic % of B is maintained in a hydrogen gas atmosphere at 1023–1173 K, and after said hydrogenation step, a desorption step where hydrogen is removed from the alloy.

7. The isotropic magnet powder according to claim 6, wherein 0.01–0.7 atomic % of La is included in the 12–16 atomic % of R.

8. An anisotropic magnet powder made by a d-HDDR process comprising a low-temperature hydrogenation step where an alloy comprising a main composition of Fe;

12–16 atomic % of R, where R is at least one selected from the group consisting of rare-earth elements and yttrium (Y), and 0.01–1.0 atomic % of lanthanum (La) is included in the 12–16 atomic % of R; and 10.8–15 atomic % of B is maintained in a hydrogen gas atmosphere at not more than 873 K, after said low-temperature hydrogenation step, a high-temperature hydrogenation step where the alloy is maintained in a hydrogen gas atmosphere at 20–100 kPa and 1023–1173 K, after said high-temperature hydrogenation step, a first evacuation step where the alloy is maintained in a hydrogen gas atmosphere at 0.1–20 kPa and 1023–1173 K, and after said first evacuation step, a second evacuation step where hydrogen is removed from the alloy.

9. The anisotropic magnet powder according to claim 8, wherein 0.01–0.7 atomic % of La is included in the 12–16 atomic % of R.

10. A bonded magnet made by compression molding a mixture of a binder and an isotropic magnet powder obtained by a HDDR process comprising a hydrogenation step where an alloy comprising
a main component of Fe;
12–16 atomic % of R, where R is at least one selected from the group consisting of rare-earth elements and yttrium (Y), and 0.01–1.0 atomic % of lanthanum (La) is included in the 12–16 atomic % of R; and
10.8–15 atomic % of B is maintained in a hydrogen gas atmosphere at 1023–1173 K, and after said hydrogenation step, a desorption step where hydrogen is removed from the alloy.

11. The bonded magnet according to claim 10, wherein 0.01–0.7 atomic % of La is included the 12–16atomic % of R.

12. A bonded magnet made by compression molding a mixture of a binder and an anisotropic magnet powder obtained by a d-HDDR process comprising a low-temperature hydrogenation step where an alloy comprising
a main component of Fe;
12–16 atomic % of R, where R is at least one selected from the group consisting of rare-earth elements and yttrium (Y), and 0.01–1.0 atomic % of lanthanum (La) is included in the 12–16 atomic % of R; and
10.8–15 atomic % of B is maintained in a hydrogen gas atmosphere at not more than 873 K, after said low-temperature hydrogenation step, a high-temperature hydrogenation step where the alloy is maintained under a hydrogen gas atmosphere at 20–100 kPa and 1023–1173 K, after said high-temperature hydrogenation step, a first evacuation step where the alloy is maintained under a hydrogen gas atmosphere at 0.1–20 kPa and 1023–1173 K, and after said first evacuation step, a second evacuation step where hydrogen is removed from the alloy.

13. The bonded magnet according to claim 12, wherein 0.01–0.7 atomic % of La is included in the 12–16 atomic % of R.

14. A method of producing an isotropic magnet powder by a HDDR process, the method comprising a hydrogenation step where an alloy comprising
a main component of Fe;
12–16 atomic % of R, where R is at least one selected from the group consisting of rare-earth elements and yttrium (Y), and 0.01–1.0 atomic % of lanthanum (La) is included in the 12–16 atomic % of R; and
10.8–15 atomic % of B is maintained in a hydrogen gas atmosphere at 1023–1173 K, after said hydrogenation step, a desorption step where hydrogen is removed from the alloy, and a step of producing the isotropic magnet powder.

15. The method according to claim 14, further comprising a diffusion heat treatment step, carried out on the magnet powder after said desorption step, where
a La mixture, comprising more than one selected from the group consisting of La molecules, La alloys, and La compounds, is heated to 673–1123 K and
the La diffuses onto the surface or into the interior of the magnet powder.

16. A method of producing an anisotropic magnet powder by a d-HDDR process, the method comprising a low-temperature hydrogenation step where an alloy comprising
a main component of Fe;
12–16 atomic % of R, where R is at least one selected from the group consisting of rare-earth elements and yttrium (Y), and 0.01–1.0 atomic % of lanthanum (La) is included in the 12–16 atomic % of R; and
10.8–15 atomic % of B is maintained in a hydrogen gas atmosphere at not more than 873 K, after said low-temperature hydrogenation step, a high-temperature hydrogenation step where the alloy is maintained in a hydrogen gas atmosphere at 20–100 kPa and 1023–1173 K, after said high-temperature hydrogenation step, a first evacuation step where the alloy is maintained in a hydrogen gas atmosphere at 0.1–20 kPa and 1023–1173 K, after said first evacuation step, a second evacuation step where hydrogen is removed from the alloy, and a step of producing the anisotropic magnet powder.

17. The method according to claim 16, further comprising a diffusion heat treatment step, carried out on the magnet powder after said first evacuation step or after said second evacuation step, where
a La mixture, comprising more than one selected from the group consisting of La molecules, La alloys, La compounds, hydrides of La molecules, hydrides of La alloys, and hydrides of La compounds, is heated to 673–1123 K and
the La diffuses onto the surface or into the interior of the magnet powder.

18. The isotropic magnet powder according to claim 6, wherein the isotropic magnet powder comprises particles of the alloy; and a concentration of La at the surface of at least one of the particles is greater than a concentration of La at the center of the at least one of the particles.

19. The anisotropic magnet powder according to claim 8, wherein the anisotropic magnet powder comprises particles of the alloy; and a concentration of La at the surface of at least one of the particles is greater than a concentration of La at the center of the at least one of the particles.

20. The bonded magnet according to claim 10, wherein the isotropic magnet powder comprises particles of the alloy; and a concentration of La at the surface of at least one of the particles is greater than a concentration of La at the center of the at least one of the particles.

21. The bonded magnet according to claim 12, wherein the anisotropic magnet powder comprises particles of the alloy; and a concentration of La at the surface of at least one of the particles is greater than a concentration of La at the center of the at least one of the particles.

* * * * *